US009357847B2

(12) United States Patent
Murphy

(10) Patent No.: US 9,357,847 B2
(45) Date of Patent: Jun. 7, 2016

(54) RECLINING SEATING UNIT WITH POWER ACTUATORS

(71) Applicant: Ultra-Mek, Inc., Denton, NC (US)

(72) Inventor: Marcus L. Murphy, Lexington, NC (US)

(73) Assignee: Ultra-Mek, Inc., Denton, NC (US)

( * ) Notice: Subject to any disclaimer, the term of this patent is extended or adjusted under 35 U.S.C. 154(b) by 0 days.

(21) Appl. No.: 14/498,222

(22) Filed: Sep. 26, 2014

(65) Prior Publication Data

US 2016/0088942 A1 Mar. 31, 2016

(51) Int. Cl.

| | |
|---|---|
| ***A47C 1/031*** | (2006.01) |
| ***A47C 1/024*** | (2006.01) |
| ***A47C 1/034*** | (2006.01) |
| ***A47C 1/029*** | (2006.01) |
| ***A47C 1/0355*** | (2013.01) |

(52) U.S. Cl.

CPC ..... *A47C 1/0242* (2013.01); *A47C 1/029* (2013.01); *A47C 1/034* (2013.01); *A47C 1/0345* (2013.01); *A47C 1/0355* (2013.01)

(58) Field of Classification Search

CPC .. A47C 1/0355; A47C 1/0345; A47C 1/0242; A47C 1/029

USPC ..... 297/85 M, 85 R

See application file for complete search history.

(56) References Cited

U.S. PATENT DOCUMENTS

| | | | | |
|---|---|---|---|---|
| 3,588,170 | A * | 6/1971 | Knabusch | 297/69 |
| 4,386,803 | A * | 6/1983 | Gilderbloom | A47C 1/022 297/330 |
| 4,691,964 | A * | 9/1987 | Morgan | A47C 1/0242 297/330 |
| 4,915,444 | A | 4/1990 | Rogers, Jr. | |
| 6,439,636 | B1 * | 8/2002 | Kuo | 296/65.09 |
| 6,540,291 | B2 | 4/2003 | Hoffman et al. | |
| 6,783,178 | B2 * | 8/2004 | Kasahara | 297/330 |
| 7,673,933 | B2 * | 3/2010 | Lawson | 297/69 |
| 7,731,276 | B2 | 6/2010 | Hoffman et al. | |
| 8,297,693 | B2 | 10/2012 | Hoffman et al. | |
| 8,608,240 | B2 * | 12/2013 | Marshall et al. | 297/69 |
| 9,016,790 | B2 * | 4/2015 | Voyce, IV | 297/354.13 |
| 2009/0096255 | A1 * | 4/2009 | Robertson | 297/85 |
| 2012/0112519 | A1 * | 5/2012 | Murphy et al. | 297/85 M |

* cited by examiner

*Primary Examiner* — Milton Nelson, Jr.

(74) *Attorney, Agent, or Firm* — Myers Bigel & Sibley, P.A.

(57) ABSTRACT

A reclining seating unit includes: a base; an arm frame; a seat having a seat frame; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat, the footrest unit, and the arm frame, the footrest mechanism configured to control relative movement of the footrest unit and the seat between retracted and extended positions; a first linear actuator attached to the reclining mechanism and to the seat configured to move the seat and backrest between the upright and reclined positions; and a second linear actuator attached to the footrest mechanism and to the seat configured to move the footrest unit between the retracted and extended positions.

15 Claims, 17 Drawing Sheets

RECLINING SEATING UNIT WITH POWER ACTUATORS

FIELD OF THE INVENTION

This invention relates generally to seating units, and relates more particularly to reclining seating units.

BACKGROUND OF THE INVENTION

Recliner chairs and other reclining seating units have proven to be popular with consumers. These seating units typically move from an upright position, in which the backrest is generally upright, to one or more reclined positions, in which the backrest pivots to be less upright. The movement of the seating unit between the upright and reclined positions is typically controlled by a pair of matching reclining mechanisms that are attached to the seat, backrest and base of the chair.

One particularly popular recliner is the "three-way" recliner, which has two reclined positions: a "TV position", in which the footrest or ottoman of the chair is projected forwardly from the chair while the backrest remains substantially upright; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position. Many three-way recliners are constructed such that the backrest and footrest are coupled to one another, such that reclining of the backrest cannot occur unless the footrest is already extended (i.e., the chair is in the TV position). See, e.g., U.S. Pat. No. 4,915,444 to Rogers, Jr. and U.S. Pat. No. 6,540,291 to Hoffman, which illustrate chairs of rather contemporary style with three-way reclining capability. Other reclining chairs may have decoupled reclining and footrest-extending mechanisms. See, e.g., U.S. Pat. No. 7,731,276 to Hoffman et al.

Some reclining units have employed power actuators to recline the backrest and extend the footrest. See, e.g., U.S. Pat. No. 8,297,693 to Hoffman et al. It may be desirable to provide additional reclining units with power actuation.

SUMMARY OF THE INVENTION

As a first aspect, embodiments of the invention are directed to a reclining seating unit. The reclining seating unit comprises: a base; an arm frame; a seat having a seat frame; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat, the footrest unit, and the arm frame, the footrest mechanism configured to control relative movement of the footrest unit and the seat between retracted and extended positions; a first linear actuator attached to the reclining mechanism and to the seat configured to move the seat and backrest between the upright and reclined positions; and a second linear actuator attached to the footrest mechanism and to the seat configured to move the footrest unit between the retracted and extended positions.

As a second aspect, embodiments of the invention are directed to a reclining seating unit, comprising: a base; an arm frame; a seat having a seat frame; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat, the footrest unit, and the arm frame, the footrest mechanism configured to control relative movement of the footrest unit and the seat between retracted and extended positions; a first linear actuator attached to the reclining mechanism and to the seat configured to move the seat and backrest between the upright and reclined positions; and a second linear actuator attached to the footrest mechanism and to the seat configured to move the footrest unit between the retracted and extended positions. The first linear actuator is pivotally mounted to the backrest and to the seat frame and the second linear actuator is pivotally mounted to the footrest mechanism and to the seat frame.

As a third aspect, embodiments of the invention are directed to a reclining seating unit, comprising: a base; an arm frame; a seat having a seat frame; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat, the footrest unit, and the arm frame, the footrest mechanism configured to control relative movement of the footrest unit and the seat between retracted and extended positions; a first linear actuator attached to the reclining mechanism and to the seat configured to move the seat and backrest between the upright and reclined positions; and a second linear actuator attached to the footrest mechanism and to the seat configured to move the footrest unit between the retracted and extended positions. The first linear actuator is pivotally mounted to the backrest and to the seat frame, and the second linear actuator is pivotally mounted to the base and to the footrest mechanism.

As a fourth aspect, embodiments of the invention are directed to a reclining seating unit, comprising: a base; an arm frame; a seat having a seat frame; a backrest mounted and pivotally interconnected to the seat frame; a footrest unit; a reclining mechanism attached to the seat and the backrest, the reclining mechanism configured to control relative movement of the seat and backrest between upright and reclined positions; a footrest mechanism attached to the seat, the footrest unit, and the arm frame, the footrest mechanism configured to control relative movement of the footrest unit and the seat between retracted and extended positions; a first linear actuator attached to the reclining mechanism and to the seat configured to move the seat and backrest between the upright and reclined positions; and a second linear actuator attached to the footrest mechanism and to the seat configured to move the footrest unit between the retracted and extended positions. The first linear actuator is pivotally mounted to the backrest and to the seat frame, and the second linear actuator is pivotally mounted to the arm frame and to the footrest mechanism.

DETAILED DESCRIPTION OF EMBODIMENTS OF THE INVENTION

Figure 1:
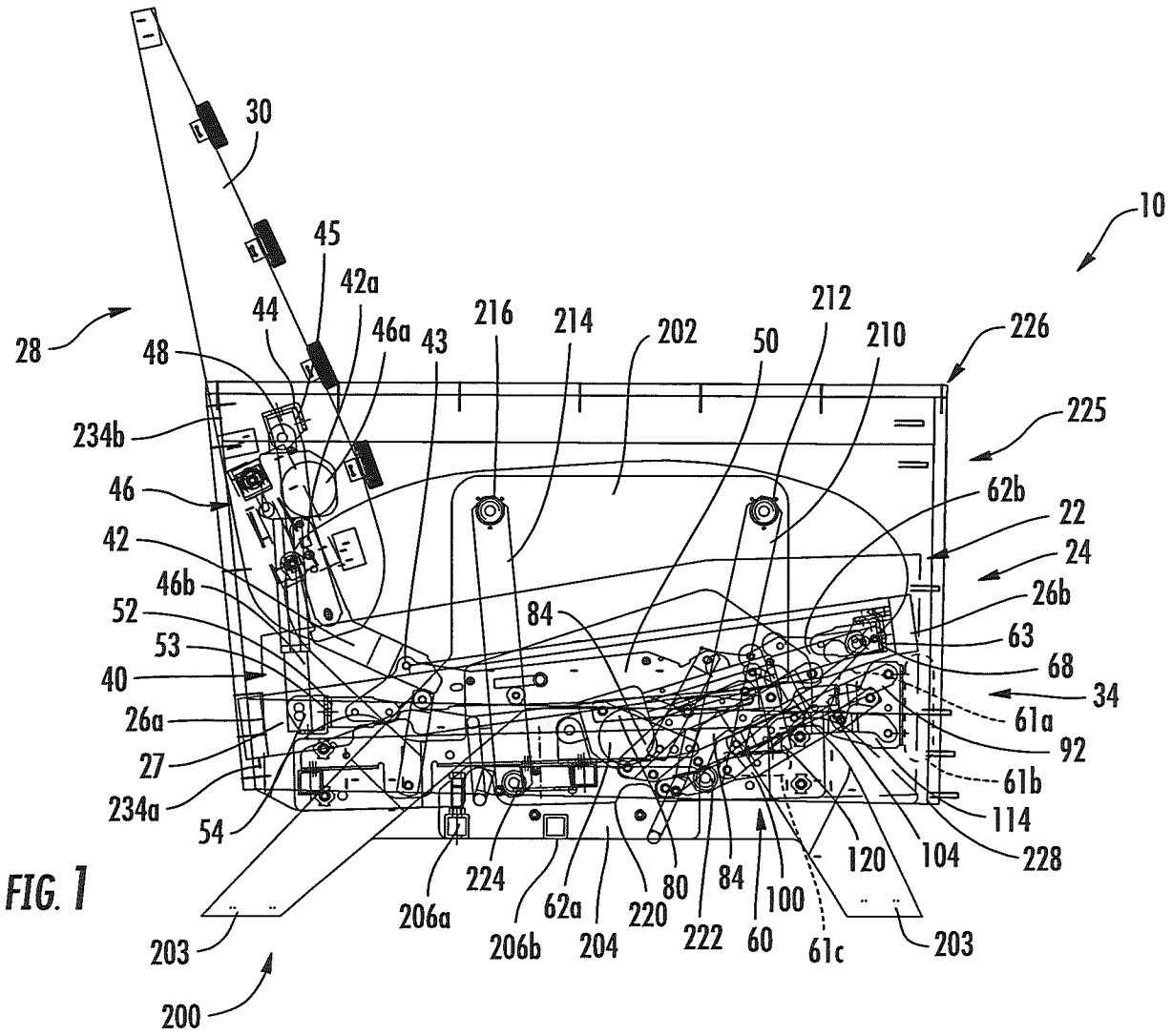
FIG. 1 is a side view of a glider-recliner chair according to embodiments of the invention, with the backrest in its upright position and the footrest unit in its retracted position.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity. Broken lines illustrate optional features or operations unless specified otherwise.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The seating units illustrated and described herein comprise a plurality of pivotally interconnected links. Those skilled in this art will appreciate that the pivots between links can take a variety of configurations, such as pivot pins, rivets, bolt and nut combinations, and the like, any of which would be suitable for use with the present invention. Also, the shapes of the links may vary as desired, as may the locations of certain of the pivots. Moreover, in some instances combinations of pivot points may be replaced by equivalent structures, such as "slider-crank" configurations, like those described in B. Paul, *Kinematics and Dynamics of Planar Machinery* 4-21 (1979).

Referring now to the figures, a glider-recliner chair, designated broadly at 10, is illustrated in FIGS. 1-5. The chair 10 includes a base 200, an arm frame 225, a seat 22, a backrest 28, a footrest unit 34, and two reclining mechanisms 40. These components identified above are described in greater detail below. As used herein to describe the relative positions of components, the terms "lateral", "outward" and derivatives thereof indicate the directions defined by a vector beginning at a vertical plane shown that bisects the chair 10 normal to the seat 22 and the backrest 28 and extending normal thereto (i.e., from the center of the chair 10 toward the arms). Conversely, the terms "inward", "inboard" and derivatives thereof indicate the direction opposite the "outward" direction. Together, the "inward" and "outward" directions comprise the "transverse" axis of the chair 10. The "rear" of the chair 10 is located at the tip of the backrest 28, and the "front" of the chair 10 is located at the end of the seat 22 farthest from the backrest 28. The "front" and "rear" directions comprise the "longitudinal" axis of the chair 10.

Figure 2:
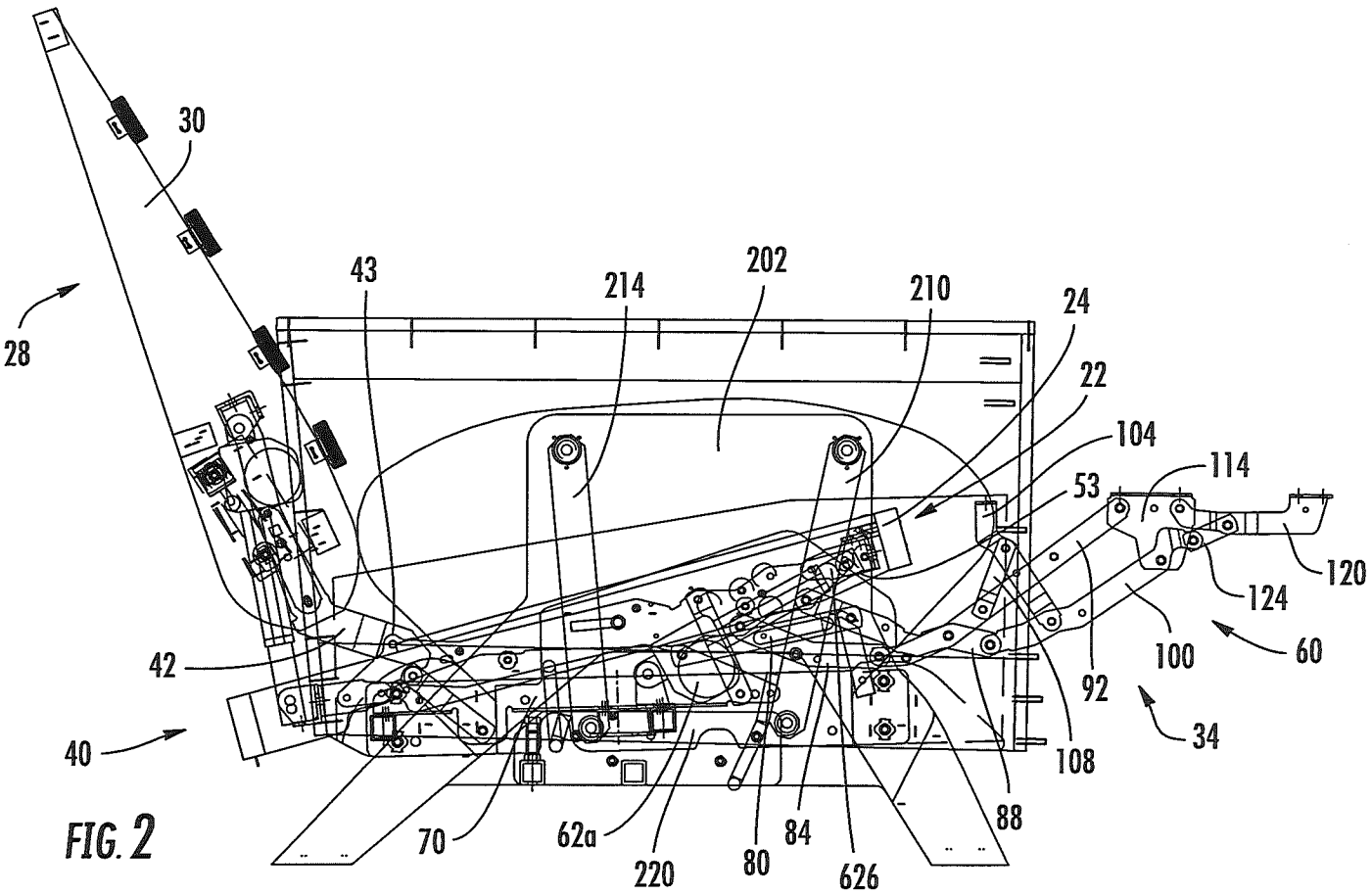
FIG. 2 is a side view of the chair of FIG. 1, with the backrest in its upright position and the footrest unit in its extended position.

Referring now to FIG. 1, the base 200 includes two longitudinally-extending foundation members 202 (only one of which is shown herein), each of which includes two feet 203 that rest on the underlying surface. A base plate 204 is mounted to each foundation member 202. Cross-members 206*a*, 206*b* span the base plates 204. A front glide link 210 is attached at a pivot 212 to each foundation member 202 and extends downwardly therefrom. A rear glide link 214 is also mounted to each foundation member 202 at a pivot 216 and extends downwardly therefrom. The lower ends of the front and rear glide links 210, 214 are pivotally attached to a glide mounting link 220 at pivots 222, 224, respectively (FIG. 2). The distance between the pivots 212 and 222 is typically between about 6 and 10 inches, and the distance between the pivots 216, 224 is between about 6 and 10 inches.

Referring to FIG. 1, the arm frame 225 includes two arms 226, only one of which is visible in FIGS. 1-5 and which will be described in detail herein. The arm 226 includes a panel 228; the panels 228 of the arms 226 are spanned by cross-members 234*a*, 234*b*. The glide mounting link 220 is mounted to the inner surface of the panel 228, thereby enabling the arm frame 225 to glide relative to the base 200.

Referring again to FIG. 1, the seat 22 includes a seat frame 24 that is generally horizontally disposed between the arms 226, with a slight incline (typically between about 1 and 12 degrees) from rear to front. The seat frame 24 includes two longitudinal rails 27, four cross-members 26*a*, 26*b*, 52, 63 (the cross-members 52, 63 have corresponding brackets 53, 68), and two seat mounting brackets 50 (only one rail 27 and on seat mounting bracket 50 are shown herein). These components are all rigidly fixed to each other to form the seat frame 24. The seat frame 24 is mounted to the arm frame 225 via a pair of footrest mechanisms 60, which are described in detail below.

The backrest 28 is disposed to be generally upright (with a typical angle of between about 55 and 80 degrees to horizontal—see FIG. 1) above the rear portion of the base 200. The backrest 28 includes a frame 30 that is attached to a pair of reclining mechanisms 40, which are in turn mounted to the seat frame 24 as described below.

The reclining mechanisms 40 mount the seat 22 and the backrest 28 to the seat frame 24 and move the backrest 28 between an upright position (FIGS. 1, 2, 4 and 5), in which the backrest 28 is generally upright and positioned above the rear portion of the seat 22, and a reclined position (FIG. 3), in which the backrest 28 is reclined relative to the upright position. The reclining mechanisms 40 are mirror images of one another about the aforementioned vertical bisecting plane; as such, only one reclining mechanism 40 is described herein, with the understanding that this discussion is equally applicable to the reclining mechanism on the opposite side of the chair 10. Also, the reclining mechanism 40 will be described first with respect to FIGS. 1 and 2, wherein the backrest 28 is in the upright position; a description of its movement to the reclined position (FIG. 3) will then follow.

As can be seen in FIGS. 1 and 2, the reclining mechanism 40 includes an angled link 42 fixed at its upper end to the backrest 28. At its lower end, the angled link 42 is attached at a pivot 43 to the rear end of the seat mounting bracket 50. An extension 42*a* is fixed to the upper end of the angled link 42. A cross-member 44 extends transversely across the backrest 28; a bracket 45 is mounted to the center of the cross-member 44. The motor 46*a* of a linear actuator 46 is mounted to the bracket 45 at a pivot 48. The retractable rod 46*b* of the linear actuator 46 is attached to the bracket 53 of the seat frame 24 at a pivot 54.

FIG. 1 illustrates the backrest 28 in its upright position. As can be seen in FIG. 1, in the upright position, the rod 46*b* is extended from the motor 46*a* of the linear actuator 46. To recline the backrest 28 relative to the seat 22, an occupant of the chair 10 actuates the linear actuator 46, thereby causing the rod 46*b* to retract within the motor 46*a*. This action causes the angled link 42, and in turn the backrest 28, to rotate about the pivot 43 (this rotation is counterclockwise from the vantage point of FIG. 1). During this action, the linear actuator 46 is free to rotate slightly counterclockwise about the pivot 54. The backrest 28 can be stopped at any position between the upright position of FIG. 1 and the fully reclined position of FIG. 3, which is reached when the rod 46*b* is fully retracted within the motor 46*a*.

Notably, the backrest 28 and footrest unit 34 are decoupled from each other, such that the backrest 28 is able to move to the reclined position independent of the position (i.e., retracted or extended) of the footrest unit 34. However, the entire footrest unit 34 moves in concert with the seat 22 in either position.

Figure 3:
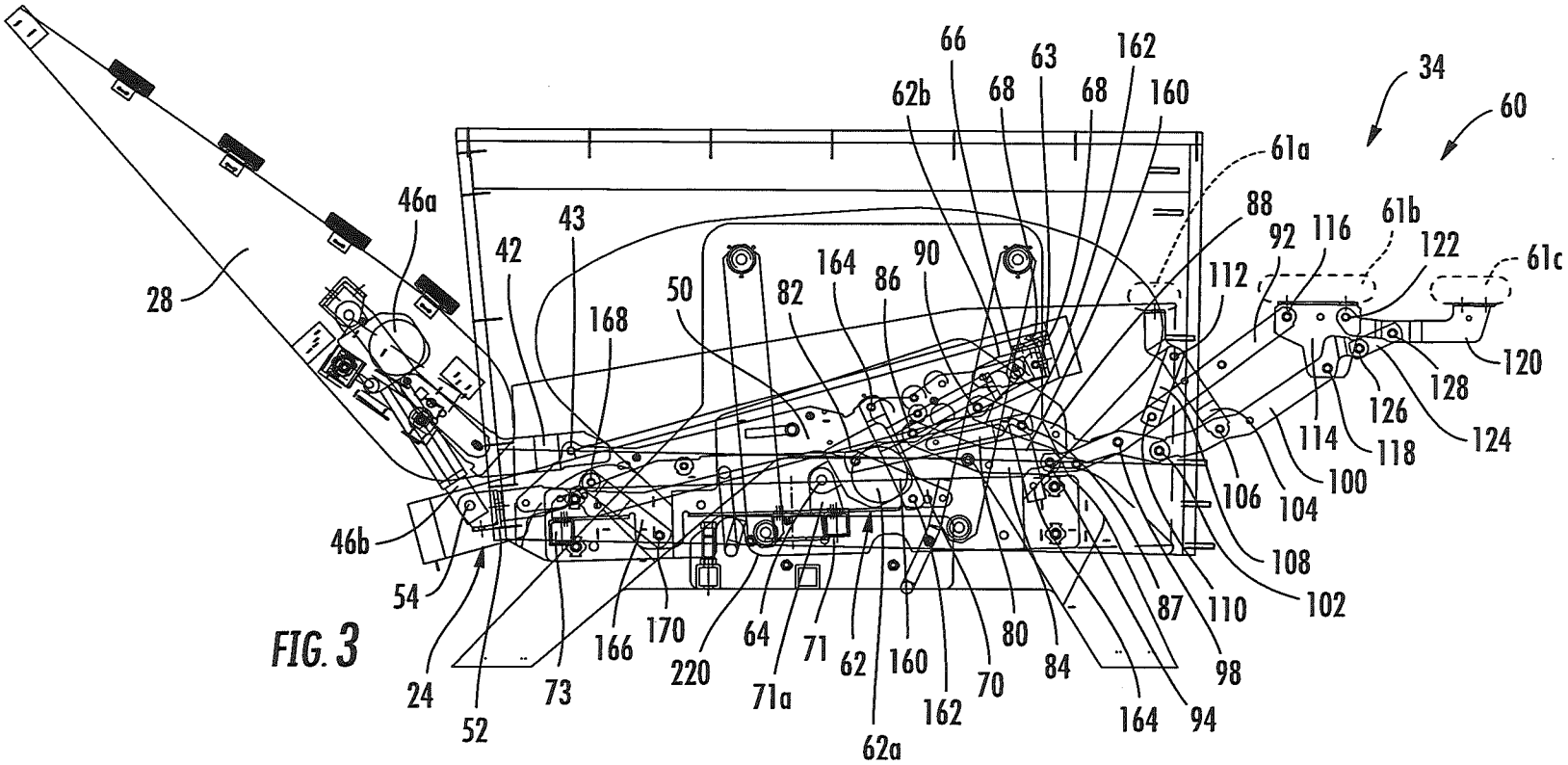
FIG. 3 is a side view of the chair of FIG. 1, with the backrest in its reclined position and the footrest unit in its extended position.

Referring now to FIGS. 1-5, the footrest unit 34 has two footrest mechanisms 60 that attach extendable footrest panels 61*a*, 61*b*, 61*c* to the seat frame 24 (only one footrest mechanism 60 is shown in the figures). The footrest mechanisms 60 move the footrest panels 61*a*, 61*b*, 61*c* between retracted positions below a front portion of the seat 22 (FIGS. 1, 4 and 5) to extended positions in front of the seat 22 (FIGS. 2 and 3). Like the reclining mechanism 40, the footrest mechanisms 60 are mirror images of each other about the vertical bisecting plane; consequently, only one of the footrest mechanisms 60 will be described herein, with the understanding that such description is applicable to the other footrest mechanism 60. For the sake of clarity, the footrest mechanism 60 will be described initially with respect to FIG. 3, in which the backrest 28 is in its reclined position and the footrest unit 34 is in its extended position.

The footrest mechanism 60 includes a linear actuator 62 that includes a motor 62*a* and a retractable rod 62*b*. The housing 62*a* is attached via a pivot 64 to a bracket 71*a* extending from a cross-member 71 that spans the glide mounting links 220. The front end of the rod 62*a* is attached at a pivot 66 to the bracket 68 that is rigidly fixed to the cross-member 63 of the seat frame 24. A footrest mounting plate 70 is mounted to the cross-member 71 and to a second cross-member 73 that spans the glide mounting links 220. A footrest drive link 80 is attached to the footrest mounting plate 70 at a pivot 82 and extends generally forwardly and slightly upwardly therefrom. A lower footrest swing link 84 is attached to the seat mounting bracket 50 at a pivot 86 and extends generally forwardly therefrom, and an upper footrest swing link 88 is attached to the seat mounting bracket 50 at a pivot 90 that is positioned slightly upwardly and forwardly from the pivot 86 and extends generally forwardly therefrom. The footrest drive link 80 is attached to the lower footrest swing link 84 at a pivot 87. An upper footrest extension link 92 is attached to the forward end of the lower footrest swing link 84 at a pivot 94 and extends forwardly and upwardly therefrom. Similarly, a lower footrest extension link 100 is attached to the upper footrest swing link 88 at a pivot 102 and extends forwardly and upwardly therefrom. The upper footrest extension link 92 is also pivotally attached to the upper footrest swing link 88 at a pivot 98.

The footrest 61*a* is attached to the footrest mechanism 60 via a rear footrest link 104 that is pivotally attached to the lower footrest extension link 100 at a pivot 106 and extends upwardly and rearwardly therefrom to meet the footrest 61*a*. A brace 108 is attached to the rear footrest link 104 at a pivot 112 and to the upper footrest extension link 92 at a pivot 110. The footrest 61*b* is mounted on a middle footrest bracket 114, which is attached to the upper and lower footrest extension links 92, 100 at pivots 116, 118 respectively. The footrest 61*c* is mounted to a front footrest link 120, which is attached to the middle footrest bracket 114 at a pivot 122 and extends forwardly therefrom to meet the footrest 61*c*. A brace 124 is attached to the front end of the lower footrest extension link 100 at a pivot 126 and to the front footrest link 120 at a pivot 128.

The seat frame 24 is mounted to the arm frame 225 via front and rear swing link 160, 166. The front swing link 160 is attached to the seat mounting plate 50 at a pivot 162 and extends downwardly and forwardly therefrom to a pivot 164 with the footrest mounting plate 70. The rear swing link 166 is attached to the seat mounting plate 50 at a pivot 168 and extends forwardly and downwardly therefrom to a pivot 170 with the footrest mounting plate 70.

The footrests 61*a*, 61*b*, 61*c* of the chair 10 can be moved between their retracted positions (FIGS. 1, 4 and 5) and their extended positions (FIGS. 2 and 3) through actuation of the linear actuator 62. Turning first to FIG. 1, in the upright position, the rod 62*b* of the linear actuator 62 is extended from the motor 62*a*. The footrest drive link 80 extends generally forwardly from the pivot 82. The upper and lower footrest swing links 88, 84 extend downwardly and rearwardly from their respective pivots 90, 86 with the seat mounting bracket 50, and the upper and lower footrest extension links 92, 100 extend upwardly and forwardly from, respectively, pivots 94, 102. The rear footrest link 104 extends upwardly and forwardly from the pivot 106, such that the footrest 61*a* is generally vertically disposed underneath the forward portion of the seat panel 24. The middle footrest bracket 114 is disposed such that the footrest 61*b* is vertically disposed and generally even with the front of the arms 226. The front footrest bracket 120 extends rearwardly from the pivot 122, such that the footrest 61*c* is positioned below the forward portion of the seat panel 24 and faces downwardly.

To move the footrests 61*a*, 61*b*, 61*c* from their retracted positions shown in FIG. 1 to their extended positions shown in FIGS. 2 and 3, an occupant of the chair 10 actuates the linear actuator 62, which causes the rod 62*b* to retract into the housing 62*a*. (counterclockwise from the vantage point of FIG. 1). Retraction of the rod 62*b* draws the seat frame 24 rearwardly and slightly downwardly, with its movement being controlled by the rotation of the front and rear swing links 160, 166 about the pivots 164, 170, respectively. The rearward movement of the seat frame 24 forces the footrest drive link 80 forward relative to the seat frame 24, which in turn rotates the lower footrest swing link 84 counterclockwise about the pivot 86. This action forces the upper footrest extension link 92 forward. The forward movement of the upper footrest extension link 92 rotates the upper footrest swing link 88 counterclockwise about the pivot 90, which in turn drives the lower footrest extension link 100 forward.

The forward movement of the upper and lower footrest extension links 92, 100 unfolds the footrests 61*a*, 61*b*, 61*c*. More specifically, as the upper and lower footrest links 92, 100 move forwardly, the brace 108 rotates counterclockwise about the pivot 110, which action rotates the rear footrest link 104 counterclockwise about the pivot 106. This rotation raises the footrest 61*a* and rotates it counterclockwise to a generally horizontal disposition in front of the seat 22. The movement of the upper and lower footrest extension links 92, 100 also causes the middle footrest bracket 114 and the footrest 61*b* to rotate counterclockwise to a generally horizontal disposition in front of the footrest 61*a*. Finally, the movement of the upper and lower footrest extension links 92, 100 forces the brace 124 forward and rotates it counterclockwise about the pivot 126; this rotation causes the front footrest link 120 to rotate counterclockwise about the pivot 122 to an inverted position, such that the footrest 61*c* is generally horizontally disposed and positioned in front of the footrest 61*b*.

The footrests 61*a*, 61*b*, 61*c* can be moved back to the retracted position by the occupant inducing the rod 62*b* of the linear actuator 62 to extend. The links described above reverse the motion they follow to extend the footrests 61*a*, 61*b*.

Figure 4:
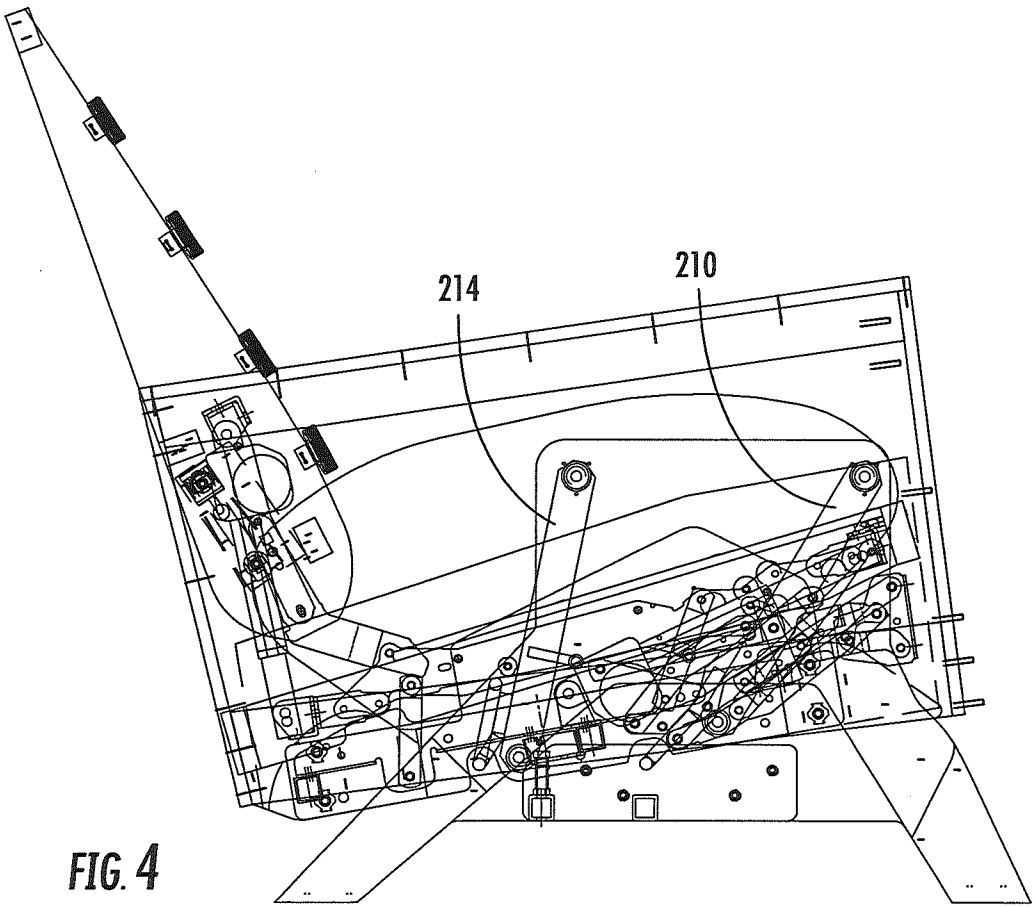
FIGS. 4 and 5 are side views of the chair of FIG. 1 showing the fore-and-aft gliding of the chair.
Figure 5:
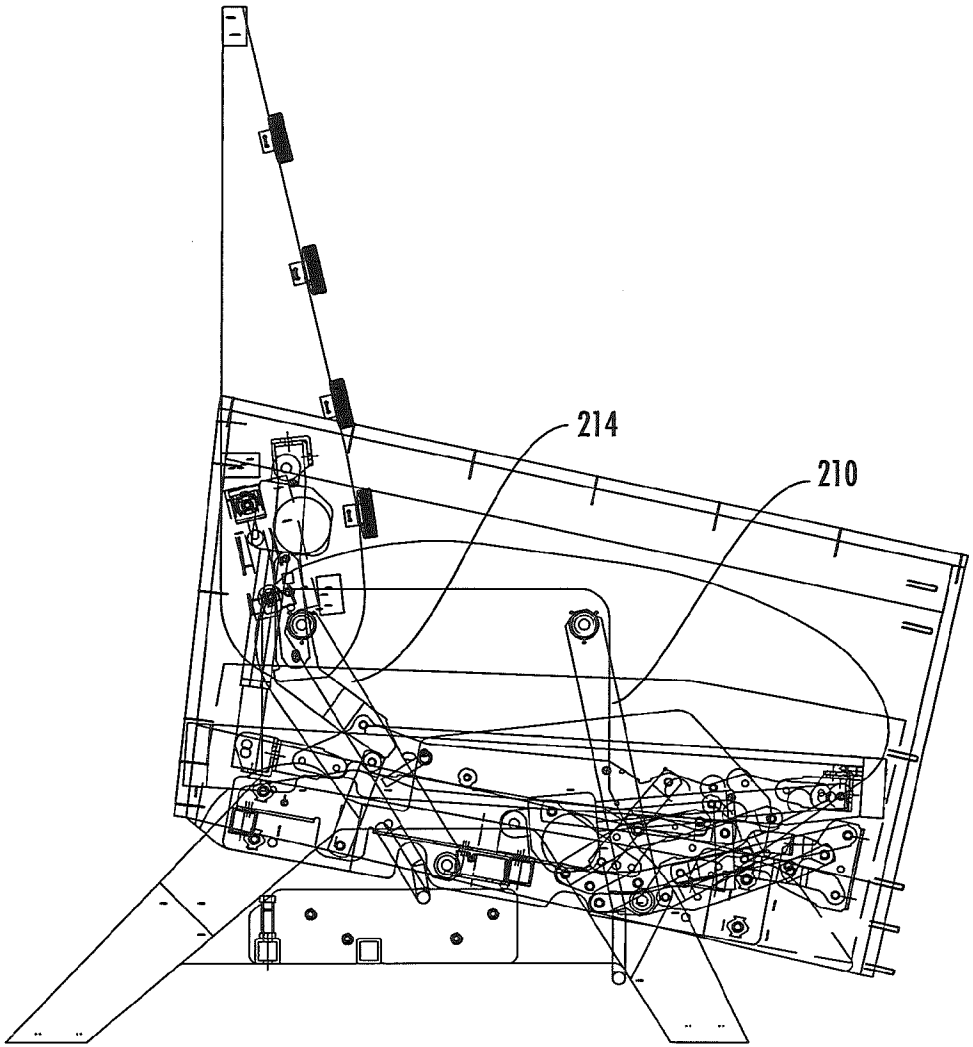

The chair 10 is free to glide along a longitudinal path defined by the front and rear glide links 214, 210 with the footrest unit 60 in either the retracted or extended position or with the backrest 28 in either the upright or reclined position (see FIGS. 4 and 5, which show forward and rearward gliding motion of the chair 10 in the upright position).

Figure 6:
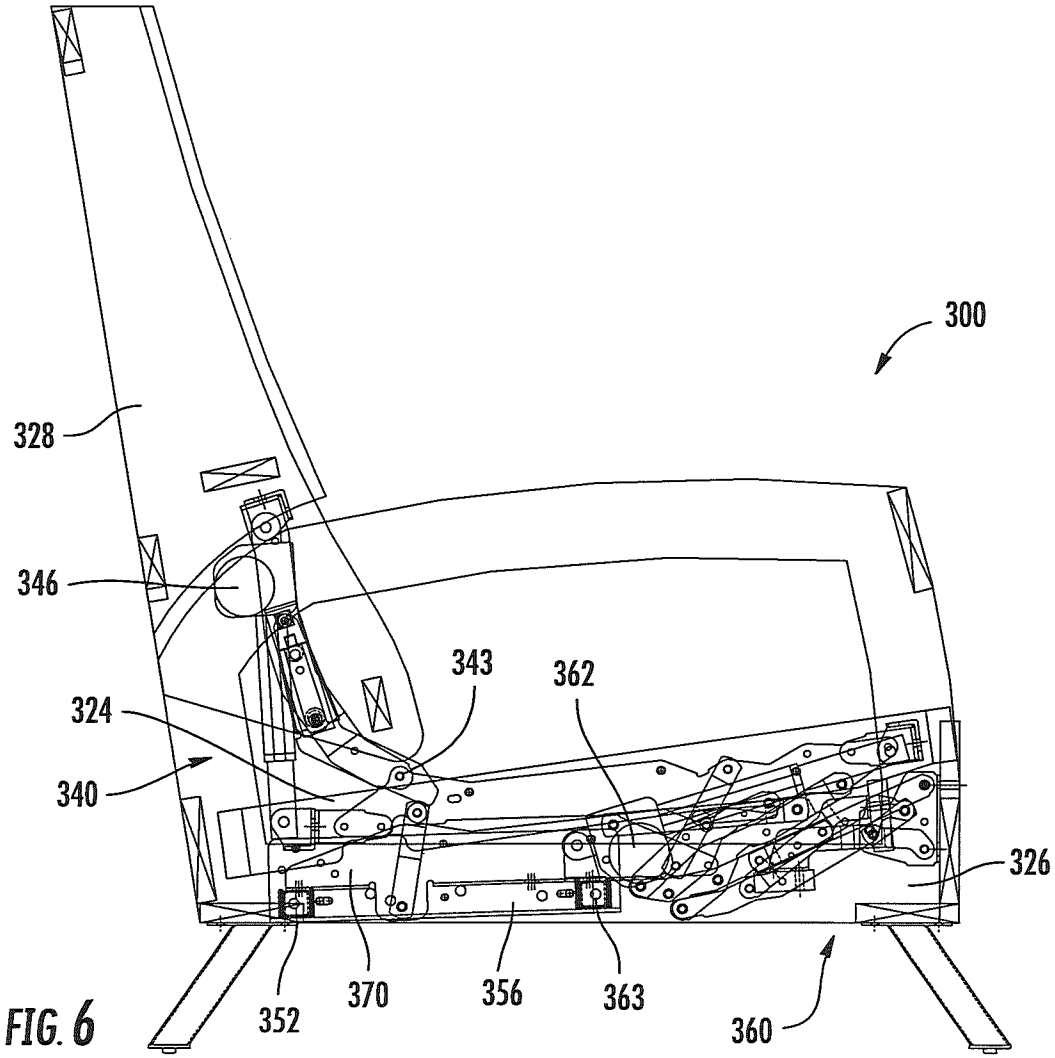
FIG. 6 is a side view of another reclining chair according to embodiments of the invention, with the backrest in its upright position and the footrest unit in its retracted position.
Figure 7:
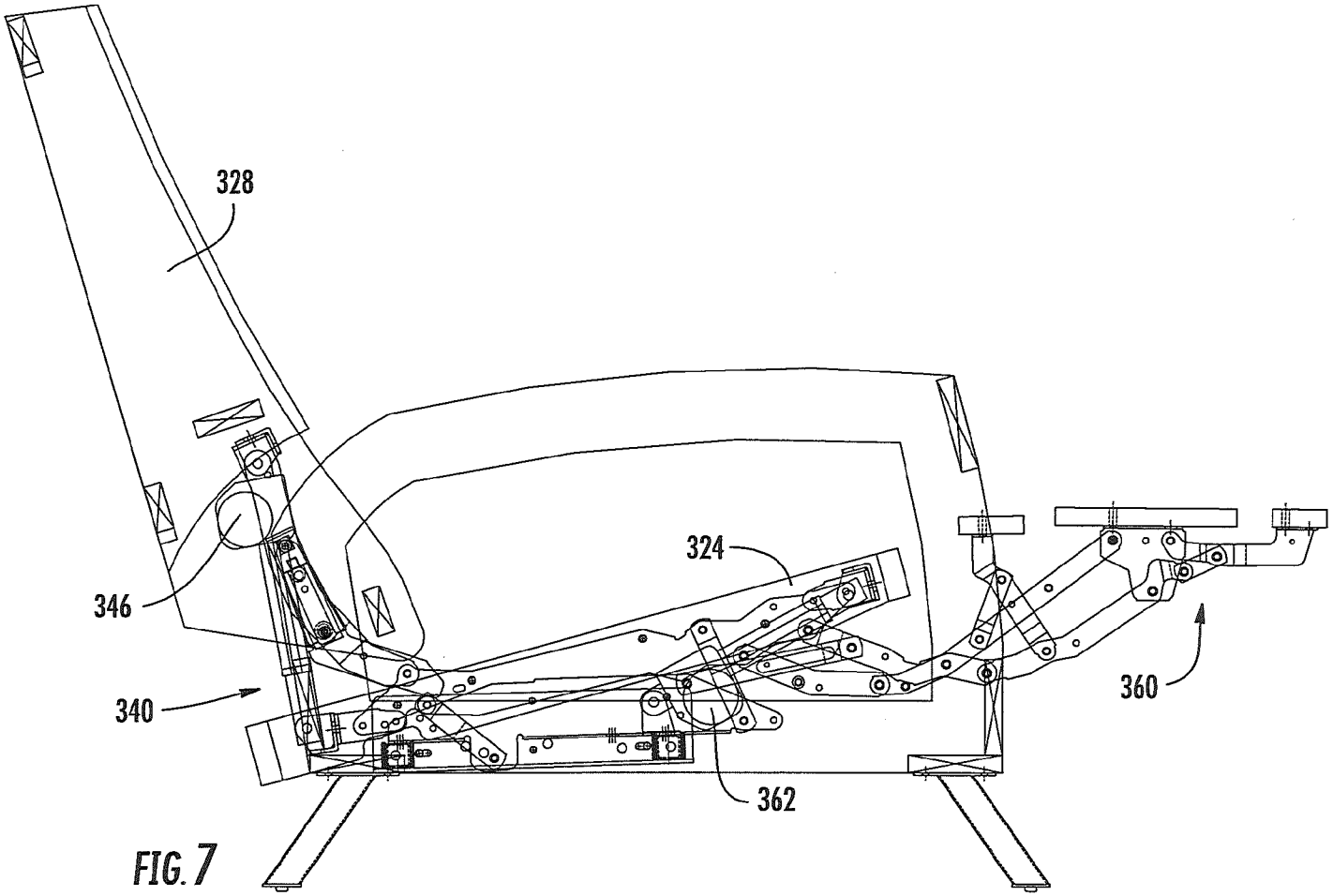
FIG. 7 is a side view of the chair of FIG. 6, with the backrest in its upright position and the footrest unit in its extended position.
Figure 8:
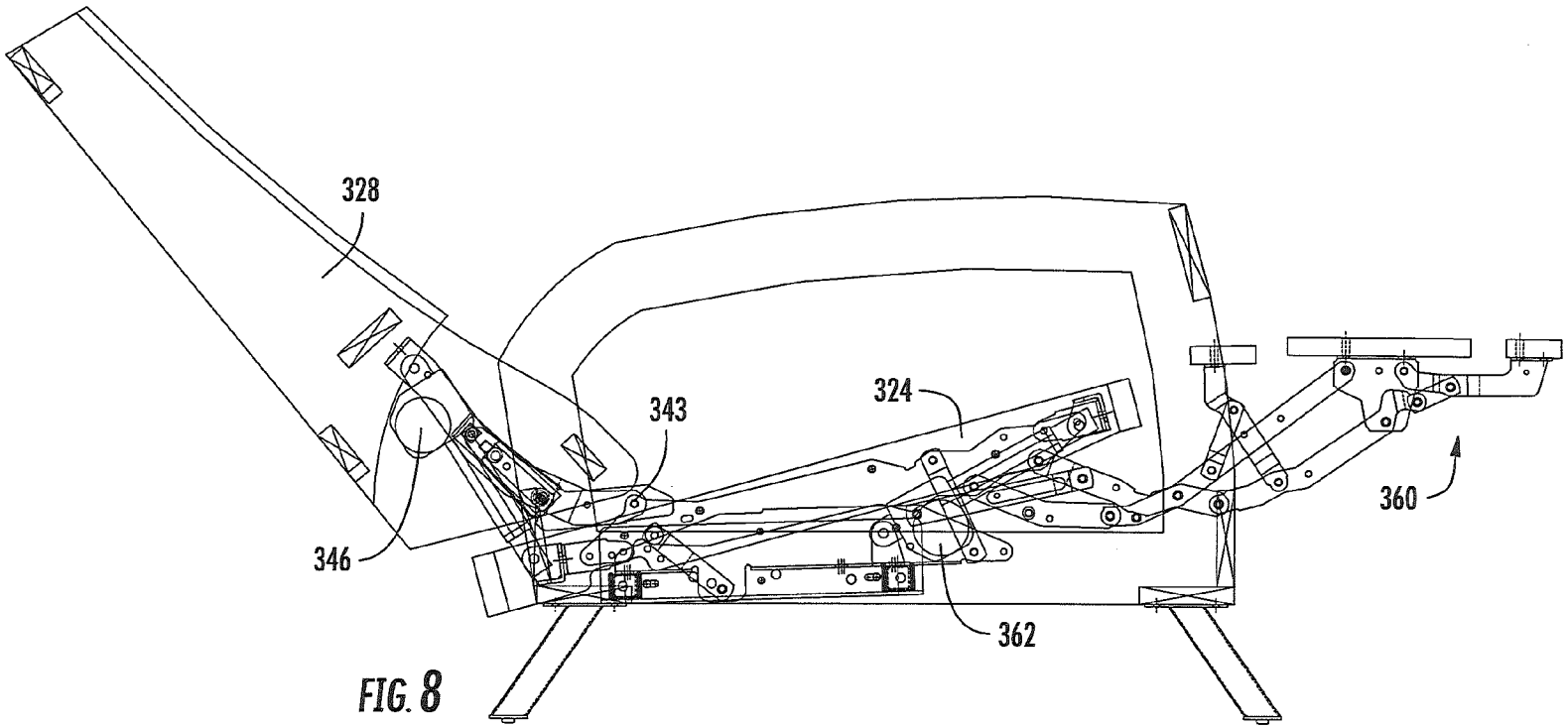
FIG. 8 is a side view of the chair of FIG. 6, with the backrest in its reclined position and the footrest unit in its extended position.

Another embodiment of a chair, designated broadly at 300, is shown in FIGS. 6-8. The chair 300 employs the same reclining mechanism 340 and footrest mechanism 360 as are described above, each of which is driven by its own linear actuator 346, 362. Also, the backrest 328 is directly pivotally interconnected to the seat frame 324 as described above. However, the chair 300 lacks a gliding mechanism; instead, the footrest mounting link 370 of the footrest mechanism 340 is mounted to cross-members 352, 363 that are fixed to an arm mounting bracket 356 that is mounted to the inner surface of the arm 326.

Retraction of the rod of the linear actuator 346 causes the backrest 328 to recline by pivoting about the pivot 343 with the seating frame 324 (FIG. 8). Retraction of the rod of the linear actuator 362 draws the seat frame 324 rearwardly, which extends the footrest mechanism 360 (FIGS. 7 and 8) as described above with respect to the footrest mechanisms 60.

Figure 9:
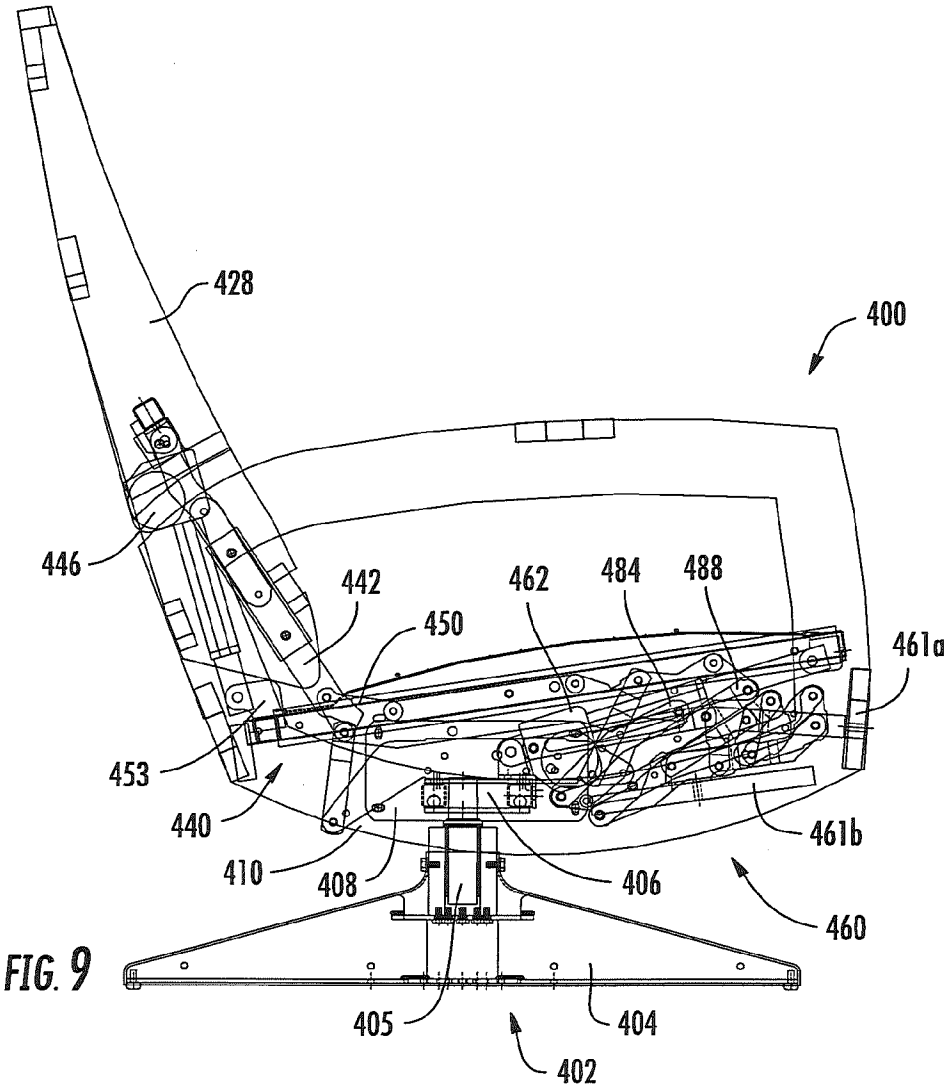
FIG. 9 is a side view of another reclining chair according to embodiments of the invention, with the backrest in its upright position and the footrest unit in its retracted position.
Figure 10:
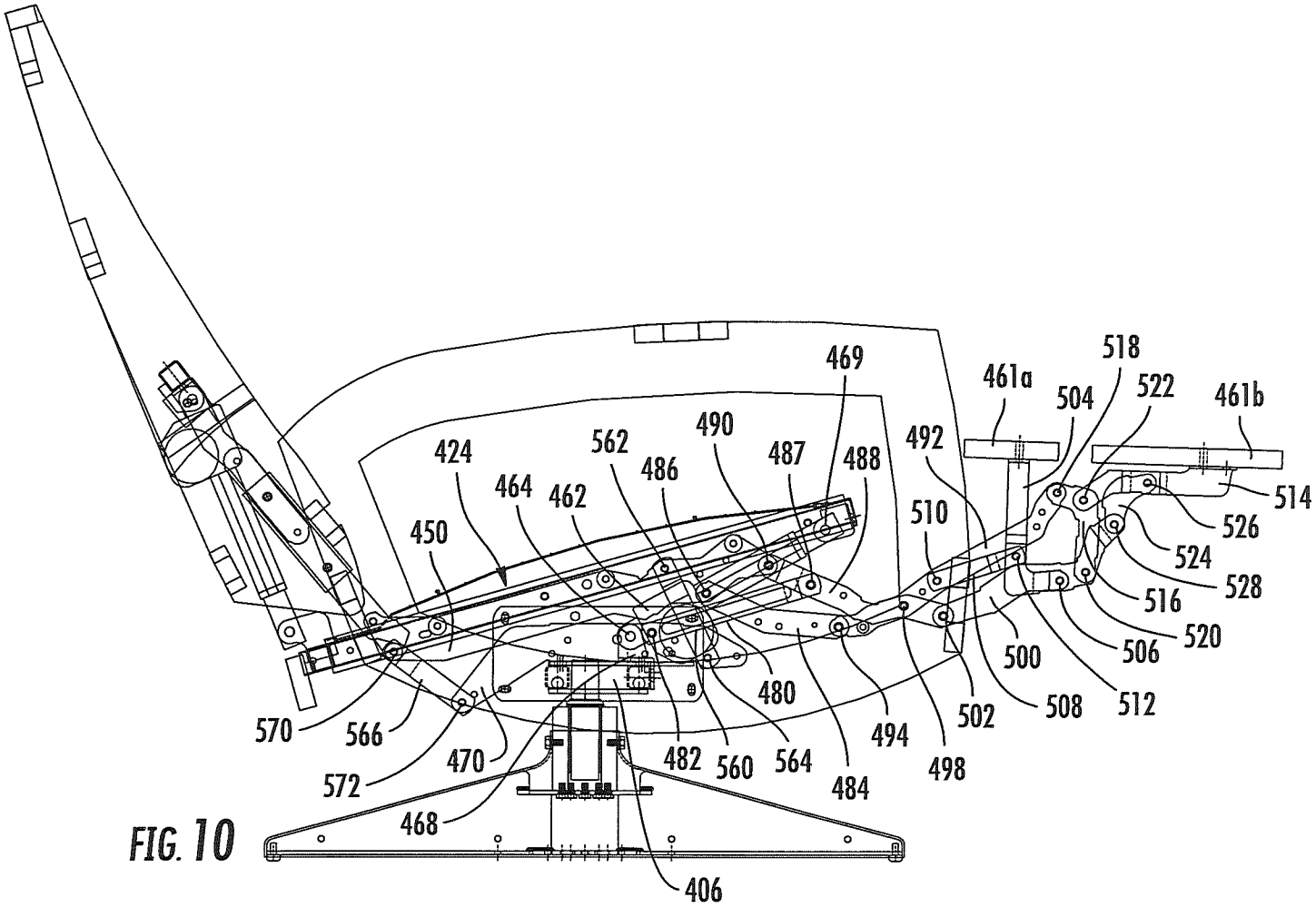
FIG. 10 is a side view of the chair of FIG. 9, with the backrest in its upright position and the footrest unit in its extended position.
Figure 11:
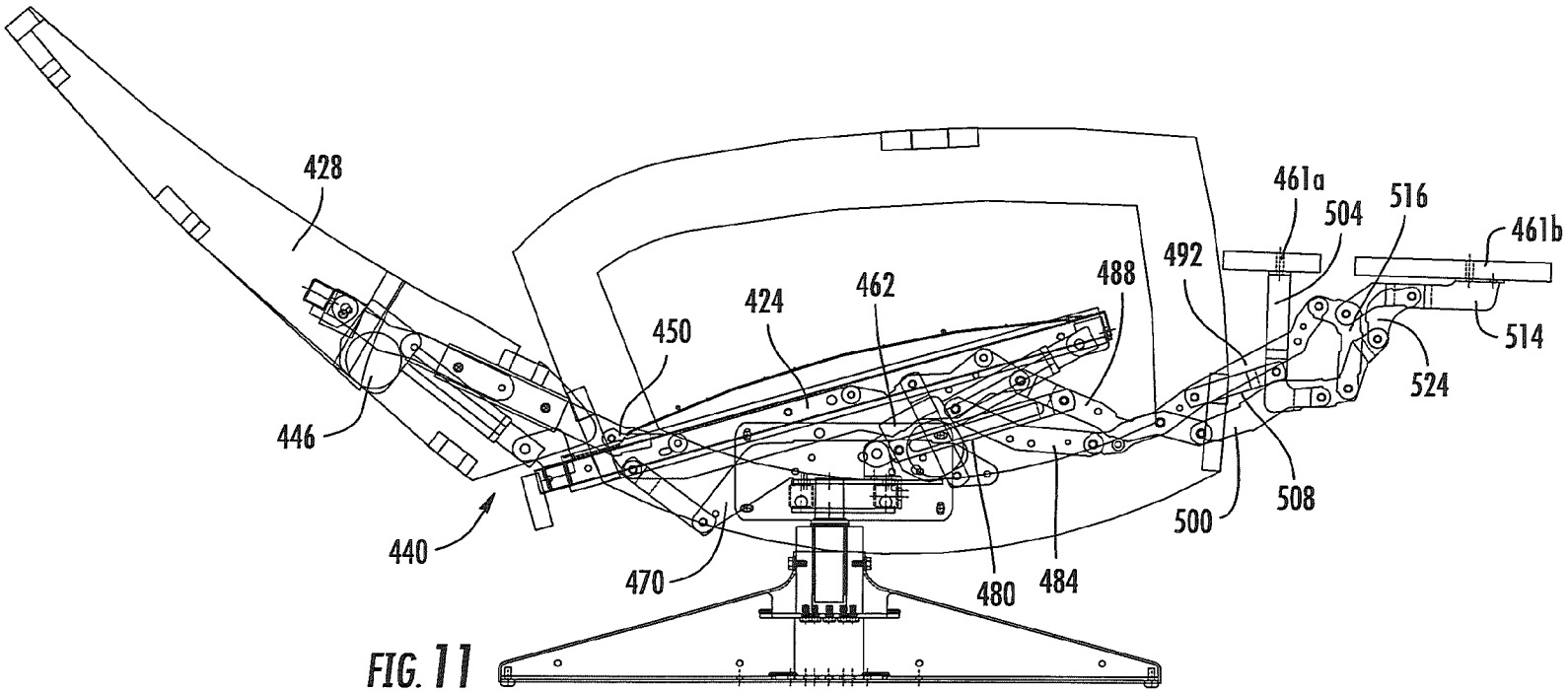
FIG. 11 is a side view of the chair of FIG. 9, with the backrest in its reclined position and the footrest unit in its extended position.

Another embodiment of a reclining chair, designated broadly at 400, is shown in FIGS. 9-11. The chair 400 is mounted on a swiveling base 402 that includes a foundation 404, a swivel unit 405 that enables the chair to pivot about a vertical axis, and a chassis 406 that is mounted to the top of the swivel unit 404. Mounting plates 408 are mounted to the lateral ends of the chassis 406 and attached to the inboard surfaces of arms 410.

The chair 400 includes a reclining mechanism 440 that reclines the backrest 428 that is very similar to the reclining mechanism 40 described above: it includes a link 442 fixed to the backrest 428 that is pivotally attached to a seat mounting bracket 450 fixed to the seat frame 424, and a linear actuator 446 that is pivotally attached to the backrest 428 and to the rear portion of the seat frame 424 via a bracket 453. The backrest 428 is moved between the upright and reclined positions in much the manner described above, with the linear actuator 446 retracting to move the backrest 428 to the reclined position of FIG. 11.

The chair 400 also includes two footrest mechanisms 460 that are mounted to the chassis 406 and to footrest panels 461*a*, 461*b*. These footrest mechanisms 460 will be described in the extended position of FIGS. 10 and 11 for clarity.

Each footrest mechanism 460 includes a footrest mounting bracket 470 mounted atop the chassis 406. A footrest drive link 480 is attached to the footrest mounting bracket 470 at a pivot 482 and extends generally forwardly and slightly upwardly therefrom. A lower footrest swing link 484 is attached to the seat mounting bracket 450 at a pivot 486 and extends generally forwardly therefrom, and an upper footrest swing link 488 is attached to the seat mounting bracket 450 at a pivot 490 that is positioned slightly upwardly and forwardly from the pivot 486 and extends generally forwardly therefrom. The footrest drive link 480 is attached to the upper footrest swing link 488 at a pivot 487. An upper footrest extension link 492 is attached to the forward end of the lower footrest swing link 484 at a pivot 494 and extends forwardly and upwardly therefrom. Similarly, a lower footrest extension link 500 is attached to the upper footrest swing link 488 at a pivot 502 and extends forwardly and upwardly therefrom. The upper footrest extension link 492 is also pivotally attached to the upper footrest swing link 488 at a pivot 498.

The footrest panel 461*a* is mounted to an L-shaped mounting link 504 that is pivotally connected at its lower, forward end to the lower footrest extension link 500 at a pivot 506. A brace 508 extends between a pivot 510 with the upper footrest extension link 492 and a pivot 512 with the mounting link 504.

The footrest panel 461*b* is mounted to a mounting link 514. A transition link 516 is attached at the forward end of the upper footrest extension link 492 at a pivot 518 and to the lower footrest extension link 500 at a pivot 520. The mounting link 514 is attached to the transition link 516 at a pivot 522. A control link 524 extends between a pivot 526 near the center of the mounting link 514 and a pivot 528 at the end of the lower footrest extension link 500.

The seat frame 424 includes a seat mounting link 450 fixed thereto. The seat frame 424 is attached to the footrest mounting bracket 470 via front and rear swing links 560, 566, which extend between, respectively, pivots 562, 564 and 570, 572. A linear actuator 462 extends between a pivot 464 with a bracket 468 on the chassis 406 and a pivot 469 with the seat frame 424.

In the retracted position shown in FIG. 9, the footrest 461*b* is generally horizontally disposed beneath the seat 22, and the footrest 461*a* is generally vertically disposed and serves as the front panel of the chair 400. The linear actuator 462 is in its extended condition. The upper and lower footrest swing links 488, 484 are folded below the seat frame 424.

To move the footrests 461*a*, 461*b* to their extended positions, the linear actuator 462 is actuated to retract. This retraction draws the forward end of the seat frame 424 rearwardly, with its movement controlled by the front and rear swing links 560, 566 as they pivot about the pivots 564, 570. As the seat frame 424 moves rearwardly, the footrest drive link 480 remains in place, with the result that it drives the upper footrest swing link 488 counterclockwise about the pivot 490. Rotation of the upper footrest swing link 488 drives the upper and lower footrest extension links 492, 500 forward, which in turn draws the lower footrest swing link 484 counterclockwise.

As the upper and lower ottoman extension links 492, 500 extend forwardly, the brace 508 and the mounting link 504 are carried forward also. The brace 508 substantially maintains its orientation, but the movement of the lower footrest extension link 500 causes the mounting link 504 to rotate about the pivot 506 such that the footrest 461*a* rises and rotates approximately 90 degrees to a generally horizontal disposition (the rotation is counterclockwise from the vantage point of FIG. 10).

Also, the extension of the upper and lower ottoman extension links 492, 500 carries the control link 524 and the mounting link 514 forward and causes the transition link 516 to rotate counterclockwise. As the transition link 516 rotates, it causes the mounting link 514 to rotate around pivot 522 (the rotation is counterclockwise from the vantage point of FIG. 11). This rotation is controlled by the control link 524, which also rotates counterclockwise. The rotation of the mounting link 514 is sufficient to invert the footrest panel 461*b* from a horizontal disposition in which the footrest panel 461*b* faces downwardly to a horizontal disposition in which the footrest panel 461*b* faces upwardly.

Figure 12:
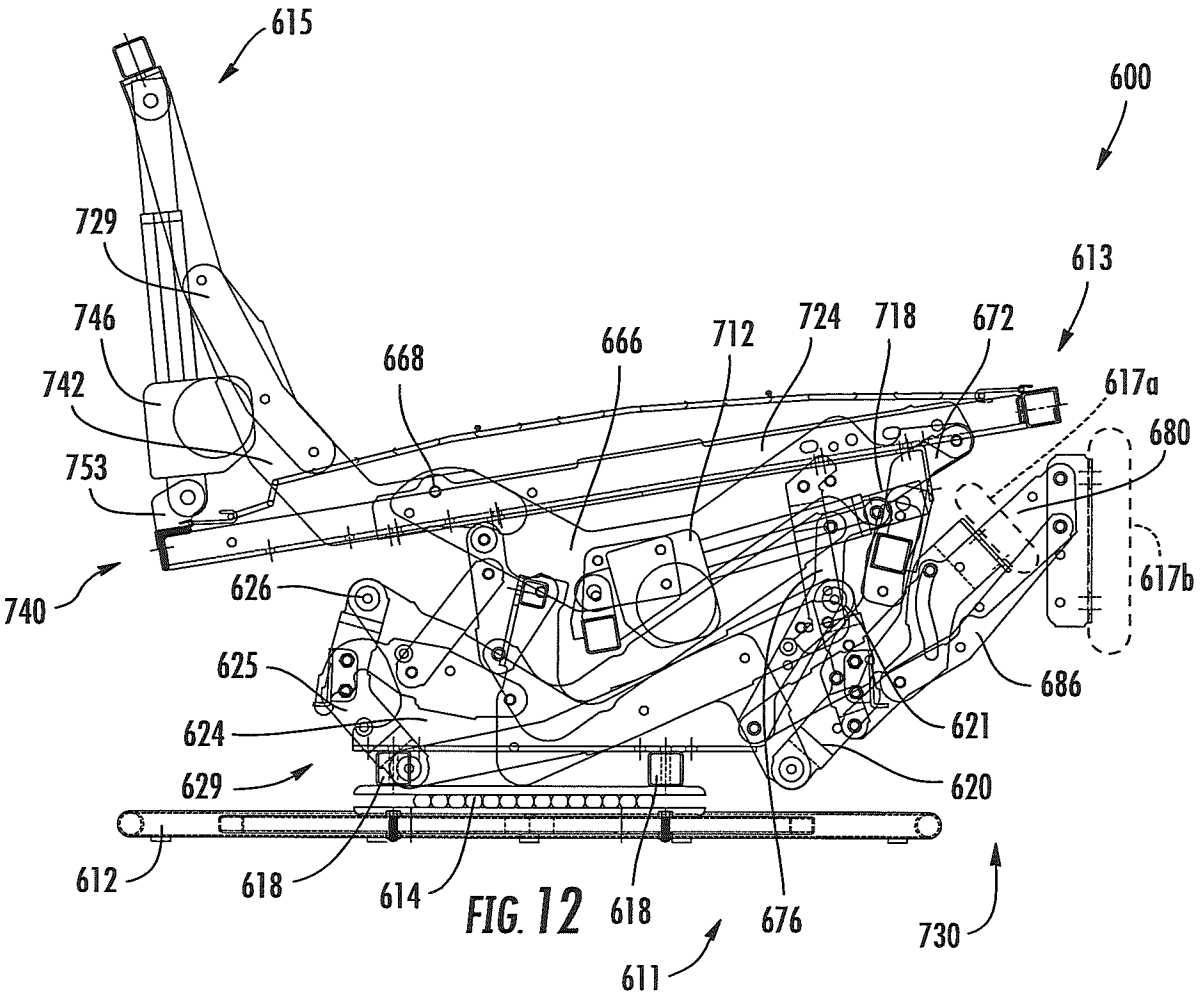
FIG. 12 is a side view of another reclining chair according to embodiments of the invention, with the backrest in its upright position and the footrest unit in its retracted position.
Figure 13:
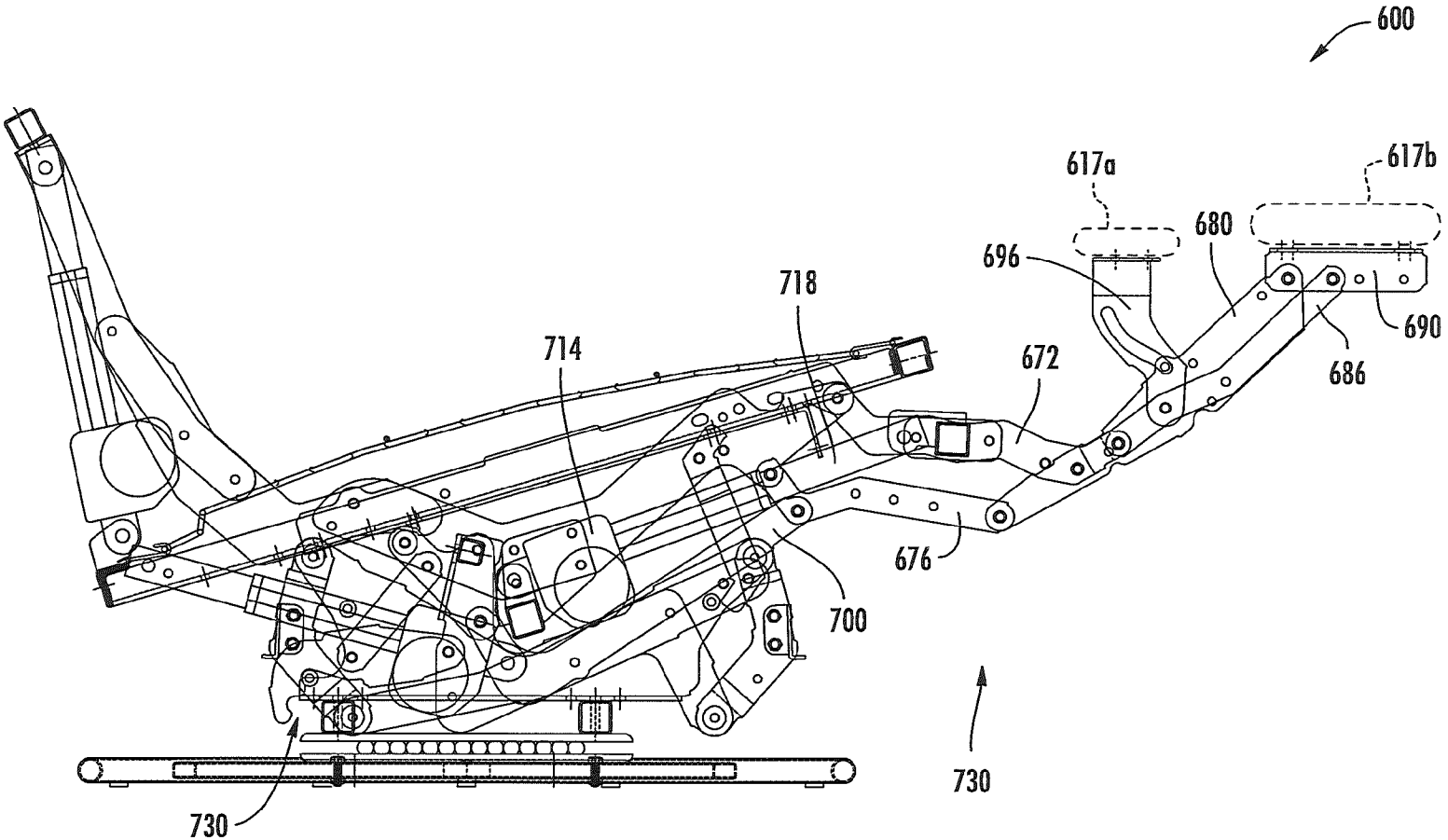
FIG. 13 is a side view of the chair of FIG. 12, with the backrest in its upright position and the footrest unit in its extended position.
Figure 14:
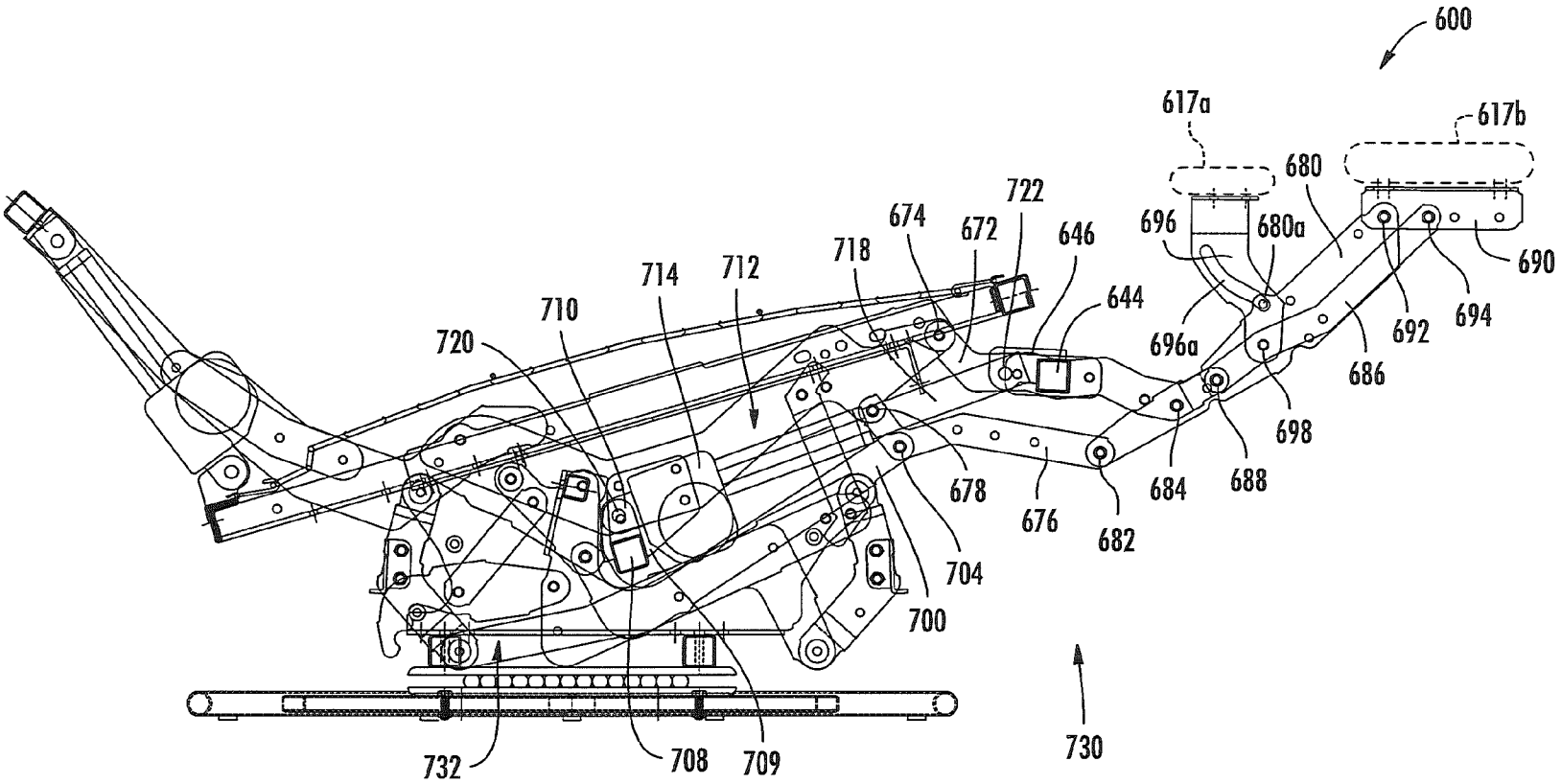
FIG. 14 is a side view of the chair of FIG. 12, with the backrest in its reclined position and the footrest unit in its extended position.

Referring now to FIGS. 12-14, another embodiment of a glider-recliner, designated broadly at 600, is illustrated therein. The chair 600 includes a base unit 611, a seat 613 that is generally horizontally disposed above the base unit 611, a backrest 615 that is generally vertically and disposed substantially above a rear portion of the seat 613, and two footrests 617*a*, 617*b*, which, in the upright position of FIG. 1, are generally vertically disposed below a front portion of the seat 613. Arms (not shown) are positioned on either side of the seat 613 and move in concert with the seat 613.

The base unit 611 includes a circular lower base 612. A swivel unit 614 is mounted onto the top of the lower base 612. Cross-members 618 are mounted atop the swivel unit 614. Those skilled in this art will recognize that the base unit 611 may take other forms that provide mounting locations for the remaining components of the chair 600; for example, the swivel unit 614 may be omitted.

Glide foundation plates 624 are mounted to the top surfaces of the cross-members 618. A front glide link 620 is attached at a pivot 621 to the front end of the glide foundation plate 624, and a rear glide link 625 is attached at a pivot 626 to the rear end of the glide foundation plate 624. The front and rear glide links 620, 625 are suspended from the glide foundation plate 624 and together form a gliding mechanism 629 that provides a gliding motion to the chair 600 when it is in its upright position (FIG. 12). Those skilled in this art will appreciate that the gliding mechanism may take other forms; it may include glide links of different shapes, or it may include a "track"-based gliding mechanism.

The chair 600 includes a reclining mechanism 740 that reclines the backrest 615 that is very similar to the reclining mechanism 40 described above: it includes a link 742 fixed to the backrest 615 (including an extension 729) that is pivotally attached to a seat adapter 666 fixed to a seat frame 724, and a linear actuator 746 that is pivotally attached to the backrest 728 and to the rear portion of the seat frame 724 via a bracket 753. The backrest 615 is moved between the upright and reclined positions in much the manner described above, with the linear actuator 746 retracting to move the backrest 728 to the reclined position.

Referring to FIGS. 13 and 14, the seat frame 724 underlies the seat 613, with the seat adapter 666 being fixed to and part of the seat frame 724. The seat adapter 666 is attached to the link 742 of the backrest 615 at a pivot 668.

Referring now to FIG. 14, footrest mechanisms 730 interconnect the footrests 617*a*, 617*b* with the seat frame 724. An upper ottoman swing link 672 is attached to a front region of the seat adapter 666 at a pivot 674 and extends downwardly and forwardly therefrom. A tripartite lower ottoman swing link 676 is attached to a pivot 678 that is located rearwardly and downwardly from the pivot 674; the lower ottoman swing link 676 extends generally forwardly from the pivot 678. An upper ottoman extension link 680 is attached to the forward end of the lower ottoman swing link 676 at a pivot 682 and extends forwardly and upwardly therefrom. Also the upper ottoman extension link 680 is attached to the upper ottoman swing link at a pivot 684. A lower ottoman extension link 686 is attached to the forward end of the upper ottoman swing link at a pivot 688 that is positioned above and forward of the pivot 684 and extends upwardly and forwardly therefrom generally parallel with the upper ottoman extension link. An outer ottoman bracket 690 is generally horizontally disposed and is attached to the upper and lower ottoman extension links 680, 686 at pivots 692, 694 respectively. The ottoman 617*b* is mounted on the outer ottoman bracket 690.

A bi-angled inner ottoman bracket 696 is attached at its lower, forward end to the lower ottoman extension link 686 at a pivot 698. At its opposite end, the inner ottoman bracket 696 supports the ottoman 617*a*. The inner ottoman bracket 696 also includes a slot 696*a* that receives a pin 680*a* located on the upper ottoman extension link 680.

An angled connecting link 700 is attached at a pivot 704 with the lower ottoman swing link 676 and extends rearwardly and slightly downwardly therefrom. The connecting link 700 is pivotally connected to a locking mechanism 732 that can prevent the seat 613 and backrest 615 from gliding relative to the base 611 when the footrests 617*a*, 617*b* are extended.

Referring still to FIG. 14, the chair 600 includes a linear actuator 712 that drives the footrests 617*a*, 617*b* between their retracted and extended positions. The actuator 712 includes a motor 714 and a retractable rod 718. The motor 714 is attached to a mounting bracket 710 at a pivot 720. The mounting bracket 710 is then attached to a cross-member 708 that extends between two plates 709 that are fixed to the seat adapter 666. The rod 718 of the actuator 712 is attached to a projecting bracket 646 at a pivot 722. The bracket 646 is then attached to a cross-member 644 that extends between the upper ottoman swing links 672 of the footrest mechanisms 730.

As can be seen in FIG. 12, in the retracted position, the rod 718 of the actuator 712 is retracted. Because the rod 718 is in its retracted position, a pantographic linkage formed by the upper and lower ottoman swing links 672, 676 and the upper and lower ottoman extension links 680, 686 is folded under the seat frame 724, which positions the footrest 617*a* underneath a forward portion of the seat frame 724 and the footrest 617*b* just forward of and below the seat frame 724 in a vertical orientation.

To move the footrests 617*a*, 617*b* from their retracted positions in FIG. 12 to their extended positions of FIGS. 13 and 14, an occupant of the chair 600 actuates the actuator 712, which causes the rod 718 to begin to extend away from the motor unit 714, thereby driving the lower ottoman swing link 676 counterclockwise about the pivot 678. Rotation of the lower ottoman swing link 676 forces the upper ottoman extension link 680 forward, which in turn draws the upper ottoman swing link 672 counterclockwise around the pivot 674. Also, the lower ottoman extension link 686 moves forwardly more than the upper ottoman extension link 680, such that the outer ottoman bracket 690 and the inner ottoman bracket 696 rotate counterclockwise (rotation of the inner ottoman bracket 696 causes the pin 680*a* to move in the slot 696*a* toward the pivot 698). The rotation of the outer and inner ottoman brackets 690, 696 induces the footrests 617*a*, 617*b* to rotate from a vertical orientation to a horizontal orientation.

In addition, the rotation of the lower ottoman swing link 676 draws the connecting link 700 forward. Movement of the connecting link 700 causes the locking mechanism 732 to prevent relative movement between the front and rear glide links 720, 725 and the seat 613, thereby preventing the seat 613 from gliding relative to the base unit 611.

Figure 15:
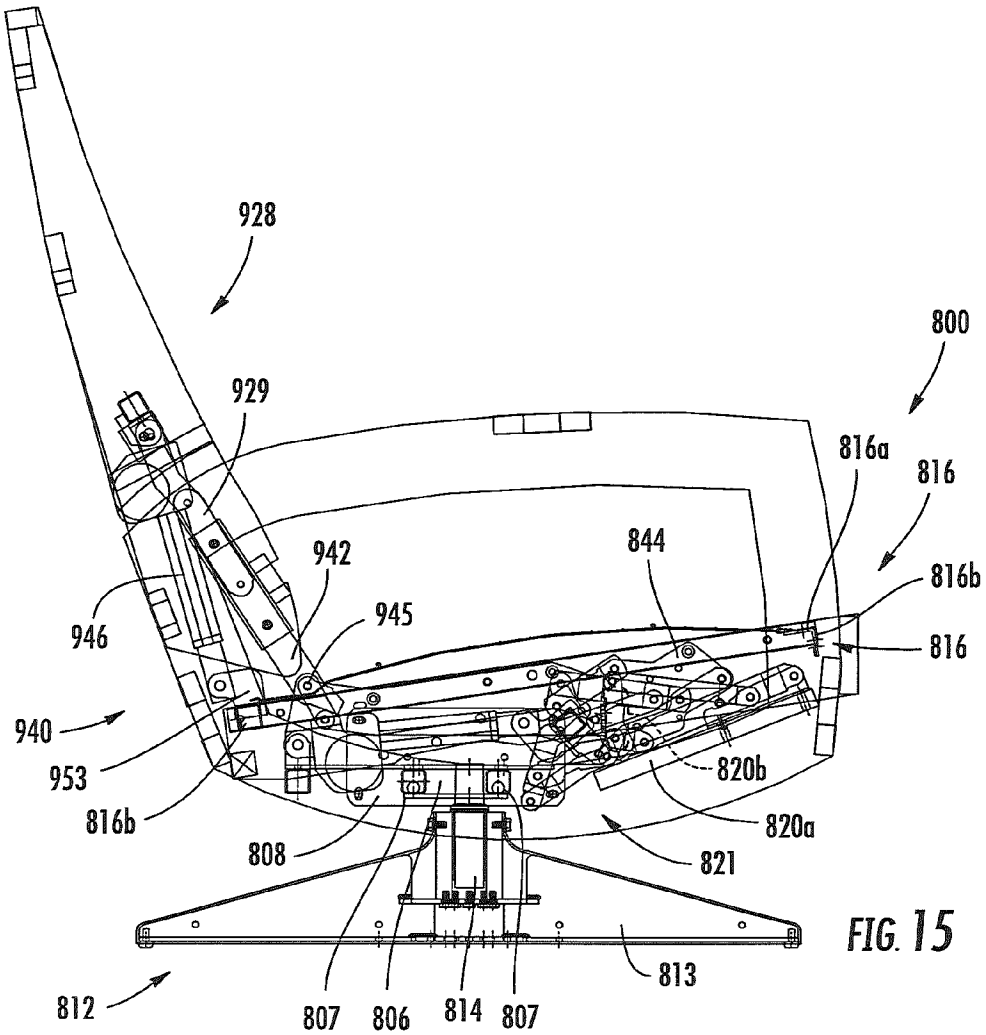
FIG. 15 is a side view of another reclining chair according to embodiments of the invention, with the backrest in its upright position and the footrest unit in its retracted position.
Figure 16:
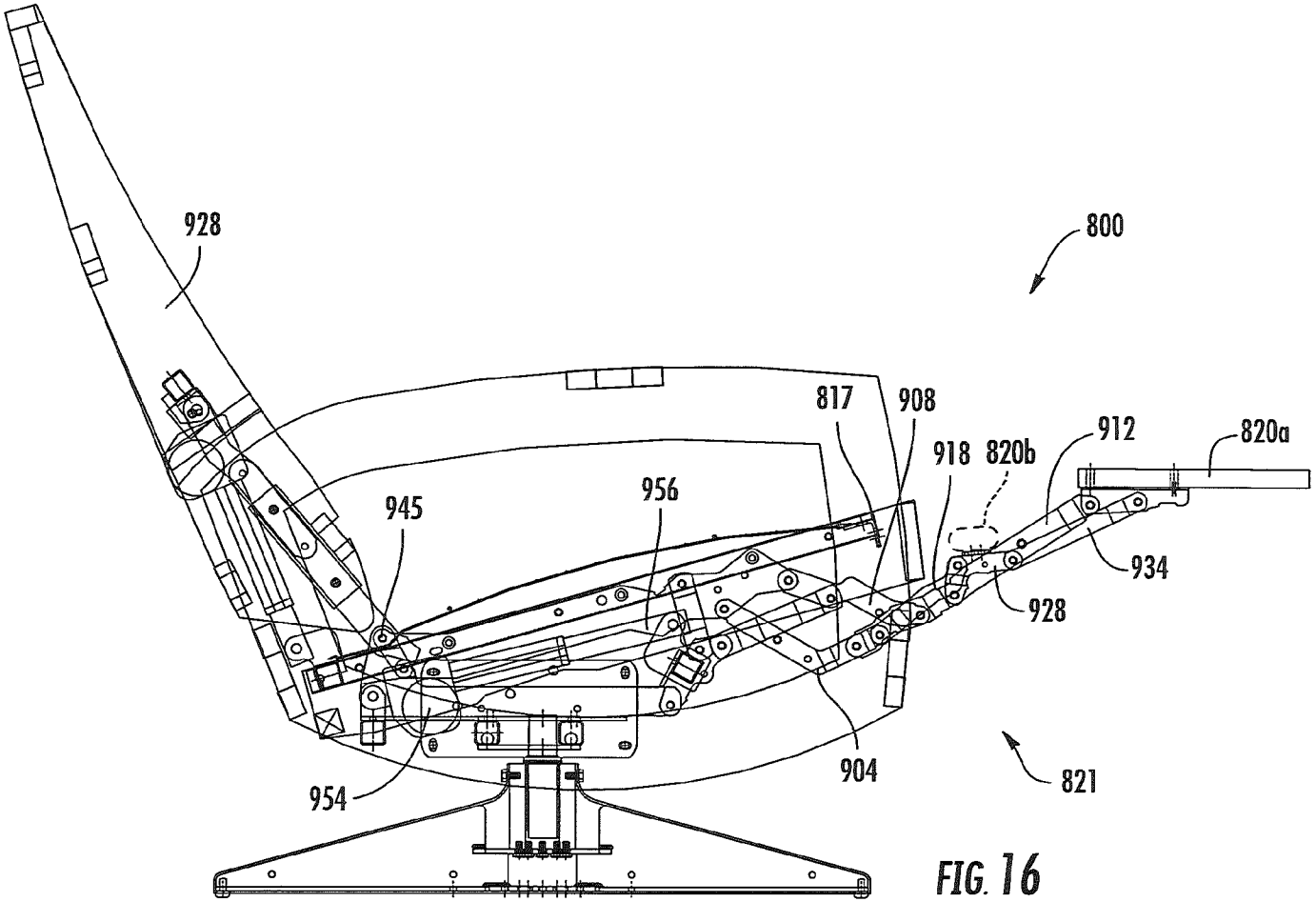
FIG. 16 is a side view of the chair of FIG. 15, with the backrest in its upright position and the footrest unit in its extended position.
Figure 17:
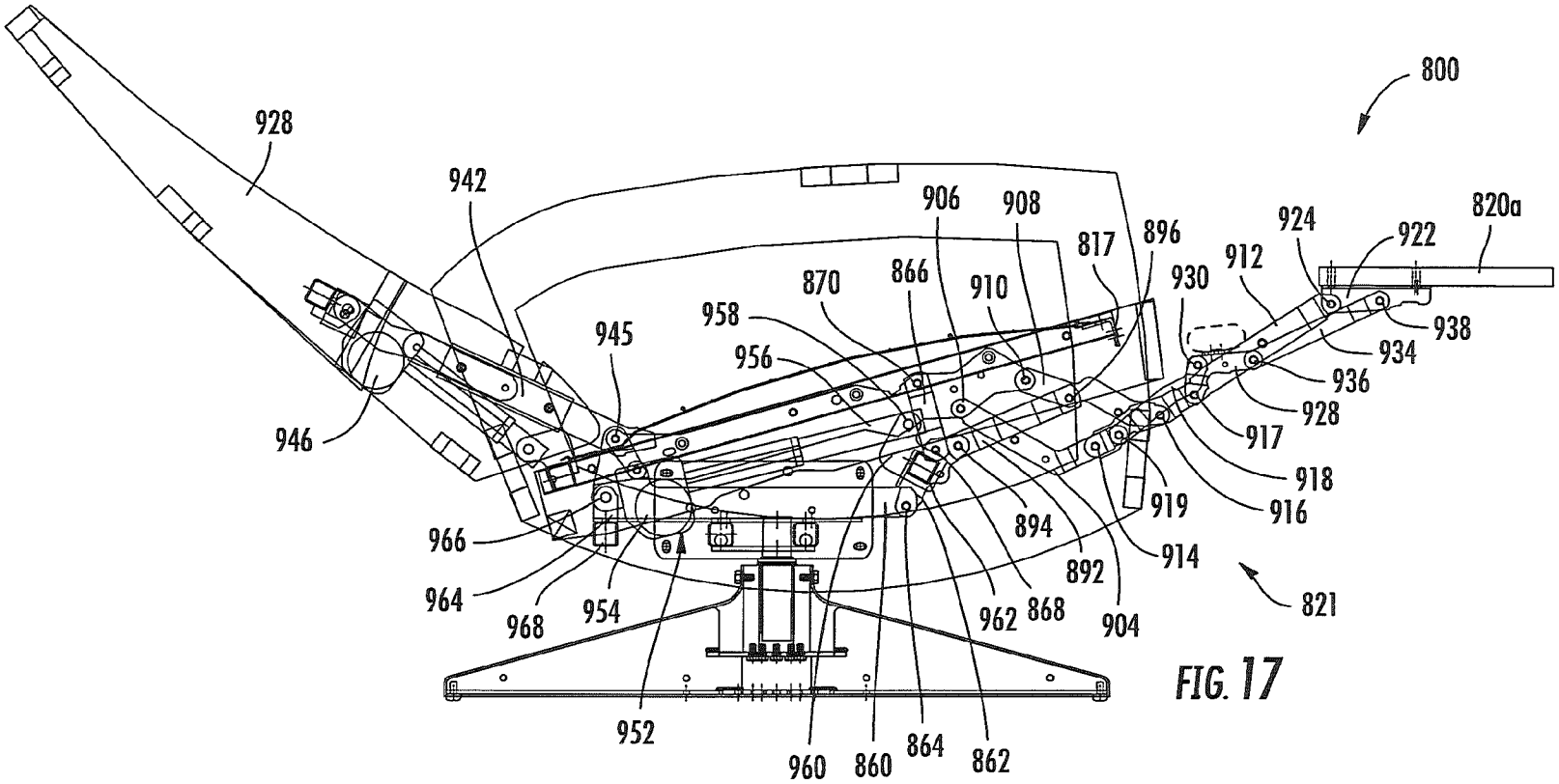
FIG. 17 is a side view of the chair of FIG. 16, with the backrest in its reclined position and the footrest unit in its extended position.

Another embodiment of a reclining chair, designated broadly at 800, is illustrated in FIG. 15-17. The chair includes a base 812 that rests on an underlying surface (e.g., the floor), a seat 816, a backrest 818, and main and auxiliary footrests 820*a*, 820*b*. These components are discussed in greater detail below.

Referring now to FIG. 15, the base 812 includes a foundation 813, a swivel unit 814 that enables the chair to pivot about a vertical axis, and a chassis 806 that is mounted to the top of the swivel unit 804. Mounting plates 808 are mounted to the lateral ends of cross-members 807 of the chassis 806 and attached to the inboard surfaces of arms 810.

Still referring to FIG. 15, the seat 816 includes side rails 816*a* and cross-members 816*b*, which combine to form a generally square structure. A serpentine seat panel 844 is mounted to each side rail 816*a* to form a rigid seat frame 817.

The chair 800 includes a reclining mechanism 940 that reclines the backrest 928 that is very similar to the reclining mechanism 40 described above: it includes a link 942 fixed to the backrest 928 (including an extension 929) that is pivotally attached to the seat panel 844 fixed to the seat frame 817 at a pivot 945, and a linear actuator 946 that is pivotally attached to the backrest 928 and to the rear portion of the seat frame 817 via a bracket 953. The backrest 928 is moved between the upright and reclined positions in much the manner described above, with the linear actuator 946 retracting to move the backrest 928 to the reclined position.

Referring to FIGS. 16 and 17, each of two footrest mechanisms 821 has a frame bracket 860 mounted to the upper surfaces of the cross-members 807. A rear projection of the frame bracket 860 shares the pivot 945 with the seat panel 844 and the backrest link 942, which enables the seat 816 to pivot relative to the base 812.

A transition link 862 is attached at its lower end to the frame bracket 860 at a pivot 864 and extends upwardly and forwardly therefrom. A control link 866 is attached at its lower end to the transition link 862 at a pivot 868 and extends upwardly and slightly rearwardly therefrom to a pivot 870 with the seat panel 844. A drive link 892 is attached to the forward end of the transition link 862 at a pivot 894. A rear ottoman drive link 904 is attached at a pivot 906 to the seat panel 844 and extends forwardly therefrom. A front ottoman drive link 908 is attached at a pivot 910 to the seat panel 844 at a pivot that is positioned forwardly and upwardly from the pivot 906. The drive link 892 is attached to the front ottoman link 908 at a pivot 896. A rear ottoman extension link 912 is attached to the forward end of the front ottoman drive link 904 at a pivot 916 and extends forwardly and upwardly therefrom; the rear ottoman extension link 912 is also attached to an intermediate portion of the rear ottoman drive link 904 at a pivot 914. A main ottoman bracket 922, to which the main ottoman 820*a* is mounted, is attached to the forward end of the rear ottoman drive link 912 at a pivot 924. An auxiliary ottoman extension link 918 is attached to the front end of the rear ottoman drive link 904 at a pivot 919 and extends forwardly and slightly upwardly therefrom. An angled auxiliary ottoman bracket 928, to which the auxiliary ottoman 820*b* is mounted, is attached at its vertex to the forward, tabbed end of the auxiliary extension link 918 at a pivot 930 and to the rear ottoman extension link 912 at a pivot 917. A main ottoman extension link 934 is attached to the forward end of the auxiliary ottoman bracket 928 at a pivot 936 and extends forwardly and upwardly therefrom to a pivot 938 with the main ottoman bracket 922. Thus, these links 904, 908, 912, 918, 922, 928 and 934 comprise a footrest linkage 950 that serves to extend and retract the ottomans 820*a*, 820*b*.

A linear actuator 952 comprising a motor 954 and a rod 956 extends the footrest linkage 821. The rod 956 is attached via a pivot 958 to a bracket 960, which is fixed to a cross-member 962 that extends between the transition links 862 on either side of the chair 800. The motor 954 is mounted via a pivot 966 to a bracket 964 that is fixed to a cross-member 968 mounted under the rear end of the frame bracket 860. In the extended position of FIGS. 16 and 17, the rod 956 is extended from the motor 954.

Referring now to FIG. 15, in the retraced position, the ottomans 820*a*, 820*b* are folded beneath the seat 816. The main ottoman 820*a* is positioned beneath the front portion of the seat 816 and is generally horizontally disposed and facing downwardly (in the illustrated embodiment, the main ottoman 820*a* forms an angle of between about 20 and 30 degrees with the underlying surface). The rear ottoman 820*b* is generally vertically disposed and positioned above the rearward edge of the main ottoman 820*a*. The links comprising the footrest linkage 821 are folded beneath the seat 816. The seat 816 typically has a pitch angle of between about 5 and 8 degrees relative to horizontal, and the backrest 818 has an angle of between about 100 and 120 degrees relative to the seat 816.

To extend the ottomans 820*a*, 820*b* to the extended position of FIGS. 16 and 17, the actuator 952 is energized to extend the rod 956 relative to the motor 954. Extension of the rod 956 rotates the transition link 862 counterclockwise about the pivot 864. This movement drives the drive link 892 forwardly, which rotates the front ottoman drive link 908 counterclockwise considerably about the pivot 910. This action also extends the rear ottoman extension link 912 and the auxiliary ottoman extension link 918, which in turn rotates the rear ottoman drive link 904 counterclockwise about the pivot 906. As the rear ottoman drive link 904 rotates, it drives the both the rear ottoman extension link 912 and the auxiliary ottoman extension link 918 forward. Movement of the auxiliary ottoman extension link 918 relative to the rear ottoman extension link 912 causes the auxiliary ottoman bracket 928 to rotate clockwise about the pivot 917. This rotation drives the main ottoman extension link 934 forward relative to the rear ottoman extension link 912, thereby causing the main ottoman 820*a* to rotate counterclockwise toward the horizontal disposition of FIGS. 16 and 17. The rotation of the auxiliary ottoman bracket 928 also rotates the auxiliary ottoman 820*b* to a horizontal disposition. Extension of the footrest linkage 950 ceases when a pin 908*a* on the front ottoman drive link 908 strikes the upper edge of the rear ottoman extension link 912.

Because the seat frame 817 shares the common pivot 945 with the frame bracket 860 and with the link 842, the seat 816 does not move rearwardly relative to the base 812 when the footrests 820*a*, 820*b* are extended or when the backrest 818 is reclined. As such, the chair 800 is less prone to tipping over, even when the footrests 820*a*, 820*b* are extended and/or the backrest 818 is reclined. Accordingly, the base 812 can remain stable with smaller front-to-back dimensions, which may be desirable for some chair styles.

It can be seen that each of the chairs 10, 300, 400, 600, 800 can provide independent reclining of the backrest and extension/retraction of the footrests via their respective pairs of linear actuators. The rearward movement of the seat caused by the retraction of the linear actuator attached to the forward portion of the seat can extend the footrests. The attachment of the linear actuator that reclines the backrest to the rear portion of the seat enables the seat to move rearwardly to extend the footrest. As can be seen above, this arrangement of independent powered reclining/footrest extension may be suitable for a stationary chair, a swiveling chair, or a gliding chair.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A reclining seating unit, comprising:
a base;
an arm frame;
a seat having a rigid seat frame;
a backrest mounted and pivotally interconnected to the seat frame;
a footrest unit;
a reclining mechanism attached to the seat and the backrest, the reclining mechanism configured to control relative movement of the seat and backrest between upright and reclined positions;
a footrest mechanism attached to the seat, the footrest unit, and the arm frame, the footrest mechanism configured to control relative movement of the footrest unit and the seat between retracted and extended positions;
a first linear pivotally actuator attached to the reclining mechanism and to the seat frame configured to move the seat and backrest between the upright and reclined positions; and
a second linear actuator attached to the footrest mechanism and to the seat configured to move the footrest unit between the retracted and extended positions.

2. The reclining seating unit defined in claim 1, wherein the base includes a gliding unit configured to allow the seat, footrest unit and backrest to reciprocate relative to the base.

3. The reclining seating unit defined in claim 1, wherein the first linear actuator is pivotally mounted to the backrest and to the seat frame.

4. The reclining seating unit defined in claim 3, wherein the first linear actuator retracts to move the backrest to the reclined position.

5. The reclining seating unit defined in claim 1, wherein the second linear actuator is pivotally mounted to the footrest mechanism and to the seat frame.

6. The reclining seating unit defined in claim 5, wherein the second linear actuator retracts to move the footrest unit to the extended position.

7. A reclining seating unit, comprising:
a base;
an arm frame;
a seat having a seat frame;
a backrest mounted and pivotally interconnected to the seat frame;
a footrest unit;
a reclining mechanism attached to the seat and the backrest, the reclining mechanism configured to control relative movement of the seat and backrest between upright and reclined positions;
a footrest mechanism attached to the seat, the footrest unit, and the arm frame, the footrest mechanism configured to control relative movement of the footrest unit and the seat between retracted and extended positions;
a first linear actuator attached to the reclining mechanism and to the seat configured to move the seat and backrest between the upright and reclined positions; and
a second linear actuator attached to the footrest mechanism and to the seat configured to move the footrest unit between the retracted and extended positions;
wherein the seat moves rearwardly relative to the base as the footrest unit moves to the extended position.

8. A reclining seating unit, comprising:
a base;
an arm frame;
a seat having a seat frame;
a backrest mounted and pivotally interconnected to the seat frame;
a footrest unit;
a reclining mechanism attached to the seat and the backrest, the reclining mechanism configured to control relative movement of the seat and backrest between upright and reclined positions;
a footrest mechanism attached to the seat, the footrest unit, and the arm frame, the footrest mechanism configured to control relative movement of the footrest unit and the seat between retracted and extended positions;

a first linear actuator attached to the reclining mechanism and to the seat configured to move the seat and backrest between the upright and reclined positions; and a second linear actuator attached to the footrest mechanism and to the seat configured to move the footrest unit between the retracted and extended positions;

wherein the first linear actuator is pivotally mounted to the backrest and to the seat frame; and wherein the second linear actuator is pivotally mounted to the footrest mechanism and to the seat frame.

9. The reclining seating unit defined in claim 8, wherein the base includes a gliding unit configured to allow the seat, footrest unit and backrest to reciprocate relative to the base.

10. The reclining seating unit defined in claim 8, wherein the seat moves rearwardly relative to the base as the footrest unit moves to the extended position.

11. The reclining seating unit defined in claim 8, wherein the first linear actuator retracts to move the backrest to the reclined position.

12. The reclining seating unit defined in claim 8, wherein the second linear actuator retracts to move the footrest unit to the extended position.

13. A reclining seating unit, comprising:

a base;

an arm frame;

a seat having a seat frame;

a backrest mounted and pivotally interconnected to the seat frame;

a footrest unit;

a reclining mechanism attached to the seat and the backrest, the reclining mechanism configured to control relative movement of the seat and backrest between upright and reclined positions;

a footrest mechanism attached to the seat, the footrest unit, and the arm frame, the footrest mechanism configured to control relative movement of the footrest unit and the seat between retracted and extended positions;

a first linear actuator attached to the reclining mechanism and to the seat configured to move the seat and backrest between the upright and reclined positions; and a second linear actuator attached to the footrest mechanism and to the seat configured to move the footrest unit between the retracted and extended positions;

wherein the first linear actuator is pivotally mounted to the backrest and to the seat frame; and wherein the second linear actuator is pivotally mounted to the base and to the footrest mechanism.

14. The reclining seating unit defined in claim 13, wherein the seat frame, base and backrest share a common pivot.

15. A reclining seating unit, comprising:

a base;

an arm frame;

a seat having a seat frame;

a backrest mounted and pivotally interconnected to the seat frame;

a footrest unit;

a reclining mechanism attached to the seat and the backrest, the reclining mechanism configured to control relative movement of the seat and backrest between upright and reclined positions;

a footrest mechanism attached to the seat, the footrest unit, and the arm frame, the footrest mechanism configured to control relative movement of the footrest unit and the seat between retracted and extended positions;

a first linear actuator attached to the reclining mechanism and to the seat configured to move the seat and backrest between the upright and reclined positions; and a second linear actuator attached to the footrest mechanism and to the seat configured to move the footrest unit between the retracted and extended positions;

wherein the first linear actuator is pivotally mounted to the backrest and to the seat frame; and wherein the second linear actuator is pivotally mounted to the arm frame and to the footrest mechanism.

* * * * *